US006066009A

United States Patent [19]

Yamamoto

[11] Patent Number: 6,066,009

[45] Date of Patent: May 23, 2000

[54] FEMALE TERMINAL HAVING PREVENTIVE STRUCTURE FOR PERMANENT STRAIN THEREOF

[75] Inventor: Hiroshi Yamamoto, Shizuoka, Japan

[73] Assignee: Yazaki Corporation, Tokyo, Japan

[21] Appl. No.: 09/181,801

[22] Filed: Oct. 29, 1998

[30] Foreign Application Priority Data

Oct. 31, 1997 [JP] Japan ..... 9-300228

[51] Int. Cl.[7] ..... H01R 11/22; H01R 13/11

[52] U.S. Cl. ..... 439/852

[58] Field of Search ..... 439/852, 851

[56] References Cited

U.S. PATENT DOCUMENTS 5,480,320 1/1996 Saimoto ..... 439/852

FOREIGN PATENT DOCUMENTS 7-42005 7/1995 Japan .

*Primary Examiner*—Lincoln Donovan
*Assistant Examiner*—Javaid Nasri
*Attorney, Agent, or Firm*—Morgan, Lewis & Bockius LLP

[57] ABSTRACT

A female terminal for electrically contacting with a male terminal is disclosed. The female terminal comprises a first side wall, an elastic contact member formed on an inner face of the first side wall and extending in a longitudinal direction of the female connector, the elastic contact member having a flexibility to receive the male terminal, and a support member formed on the inner face of the first side wall for supporting the elastic contact member flexed by the male terminal, the support member having a support face being inclined in substantially parallel to the elastic contact member such that the flexed elastic contact member is brought into a face contact with the support face.

6 Claims, 5 Drawing Sheets

FEMALE TERMINAL HAVING PREVENTIVE STRUCTURE FOR PERMANENT STRAIN THEREOF

BACKGROUND OF THE INVENTION

The present invention relates to a preventive structure for permanent strain of a terminal in which a support piece is disposed on a flexed portion of an elastic contact member of a female terminal in order to prevent the elastic contact member from being flexed excessively.

Now, FIG. 7 shows a conventional preventive structure for permanent strain of a terminal which is disclosed in Japanese Utility Model Publication No. Hei 7-42005.

According to the conventional preventive structure for the permanent strain of the terminal, within a rectangular tube-shaped electric contact part 2 of a female terminal 1, on the lower side of an elastic contact piece 3 serving as an elastic contact member, a support piece 5 is formed by raising up the same vertically from a bottom wall 4, and the leading end portion of the support piece 5 is disposed opposed to the lower side surface of the elastic contact piece 3, whereby, when the elastic contact piece 3 is flexed, the lower side surface of the elastic contact piece 3 is contacted with the leading end portion of the support piece 5 to thereby prevent not only the excessive flexure of the elastic contact piece 3 but also the permanent strain thereof caused by the excessive flexure.

On the both sides of the support piece 5, there are formed projections 6 and, in the side walls 7 of the electric contact part 2, there are formed engagement holes 8 into which the projections 6 can be engaged respectively. If the projections 6 are engaged with the engagement holes 8, then such engagement between them can prevent the support piece 5 from falling down. Thanks to this, as shown in FIG. 8, even if a male terminal 9 is inserted forcibly into the electric contact part 2, the support piece 5 supports the elastic contact piece 3 to thereby prevent the elastic contact piece 3 from being flexed excessively.

However, in the above-mentioned conventional preventive structure for the permanent strain of the terminal, because the range of the elastic contact piece 3 supported by the support piece 5 is nothing but the range that corresponds to the thickness of the support piece 5, if an excessive load is applied to the other portions of the elastic contact piece 3 than the supported portion (range) thereof in the pushing direction by the male terminal 9 or by a probe pin (not shown) for conduction check or a jig rod (not shown), then the elastic contact piece 3 can be flexed or deformed into permanent strain.

In particular, as shown in FIG. 9, when the support piece 5 is disposed on the base side of the elastic contact piece 3, if the male terminal 9 or the like is forcibly inserted into the deep side of the support piece 5, then the elastic contact piece 3 is deformed with the support piece 5 as a fulcrum thereof. On the other hand, as shown in FIG. 10, when the support piece 5 is disposed in the vicinity of the intermediate portion of the elastic contact piece 3, if the male terminal 9 or the like is forcibly inserted into the front side of the support piece 5 at a large inclination angle, then the elastic contact piece 3 is deformed in such a manner that the base side thereof is depressed.

SUMMARY OF THE INVENTION

The present invention aims at eliminating the above-mentioned drawbacks found in the conventional preventive structure for the permanent strain of the terminals. Accordingly, it is an object of the invention to provide a preventive structure for permanent strain of a terminal in which, even when a male terminal, a probe pin, a jig rod or the like is inserted into the electric contact part of a female terminal and the elastic contact member thereof is pushed strongly thereby, a support piece provided within the electric contact part is able to support the elastic contact member in a wide area to thereby be sure to prevent the elastic contact member from being flexed or deformed excessively into permanent strain.

In order to achieve the above object, there is provided a female terminal for electrically contacting with a male terminal, the female terminal comprises: a first side wall; an elastic contact member formed on an inner face of the first side wall and extending in a longitudinal direction of the female connector, the elastic contact member having a flexibility to receive the male terminal; and a support member formed on the inner face of the first side wall for supporting the elastic contact member flexed by the male terminal, the support member having a support face being inclined in substantially parallel to the elastic contact member such that the flexed elastic contact member is brought into a face contact with the support face.

Accordingly, when the elastic contact member is flexed, the elastic contact member can be supported in a wide area, which makes it possible to surely prevent the permanent strain of the elastic contact member due to the excessive flexure thereof.

The female terminal may further include: a second side wall perpendicular to the first side wall; an engagement hole formed in the second side wall; and a securing projection formed on the support face of the support member to engage with the engagement hole. The engagement hole is so formed as to be slight larger than the size of securing projection. Accordingly, the securing force of the support pieces can be increased.

In the female terminal, the support member may be integrally formed with the first side wall. And the support member may include a pair of support pieces for respectively supporting both side end portions of the elastic contact member, each of the support pieces has the support face and the securing projection.

Accordingly, the elastic contact member can always be supported in a stable manner.

DETAILED DESCRIPTION OF THE PREFERRED EMBODIMENT

Figure 1:
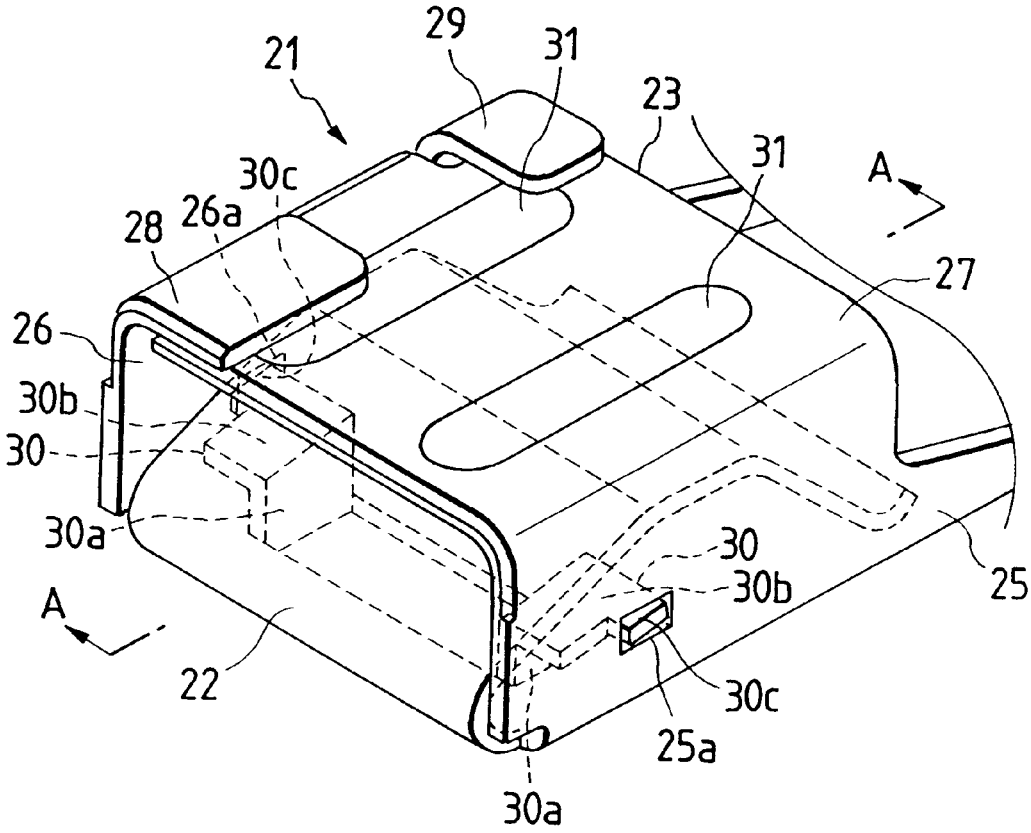
FIG. 1 is a perspective view of an electric contact part of a female terminal employed in an embodiment of a preventive structure for permanent strain of a terminal according to the present invention.
Figure 2:
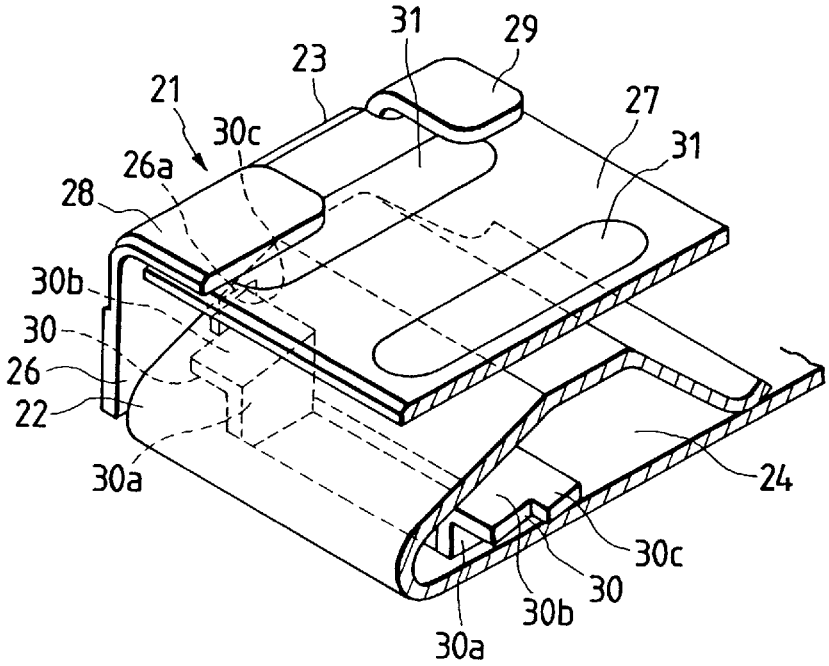
FIG. 2 is a perspective view of the electric contact part with a partial section view taken along the line A—A shown in FIG. 1.
Figure 3:
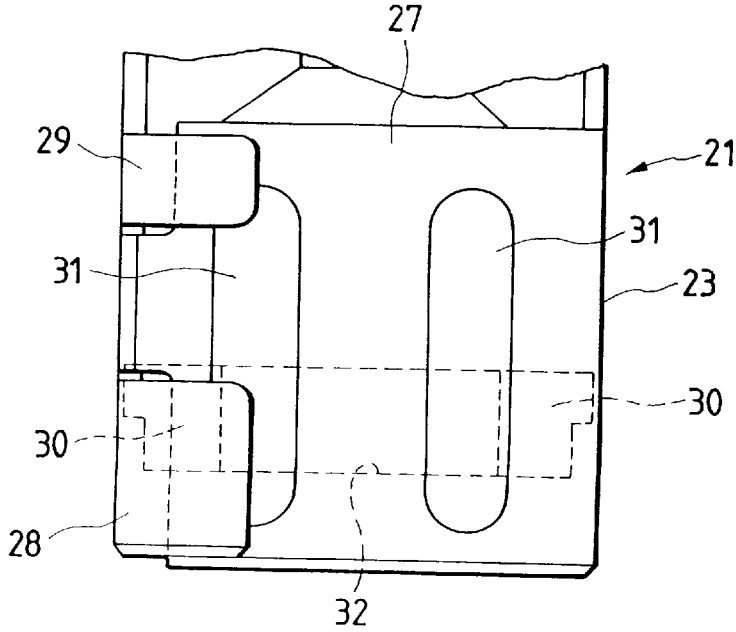
FIG. 3 is a plan view of the electric contact part shown in FIG. 1.
Figure 4:
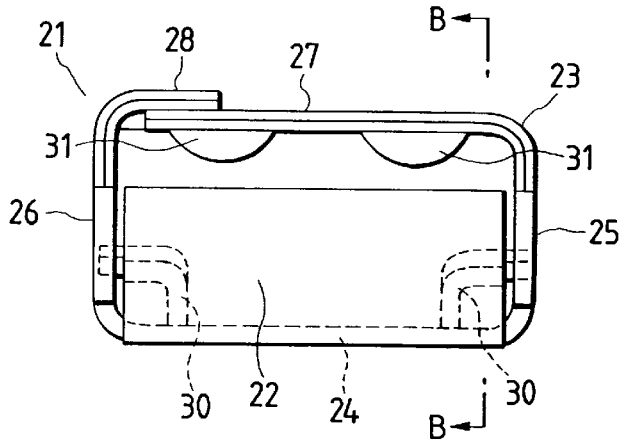
FIG. 4 is a front view of the electric contact part shown in FIG. 1.

Now, description will be given below of one embodiment of a preventive structure for permanent strain of a terminal according to the present invention with reference to the accompanying drawings. In particular, FIG. 1 is a perspective view of an electric contact part of a female terminal employed in a preventive structure for permanent strain of a terminal according to the embodiment; FIG. 2 is a perspective view of the electric contact part with a partial section view taken along the line A—A shown in FIG. 1; FIG. 3 is a plan view of the electric contact part shown in FIG. 1; and, FIG. 4 is a front view of the electric contact part shown in FIG. 1.

In FIGS. 1 and 2, reference character 21 designates a female terminal which is made of a conductive metal plate, while the female terminal 21 includes an electric contact part 23 having therein an elastic contact piece 22 serving as an elastic contact member thereof The electric contact part 23 includes two side walls 25 and 26 respectively formed by bending the both sides of a bottom wall 24. One side wall 25 is bent to thereby provide a ceiling wall 27, whereas the other side wall 26 includes staking pieces 28 and 29 respectively extended from the edge thereof. The electric contact part 23 is pressed and fixed by these staking pieces 28 and 29 to thereby provide a rectangular tube shape. Also, in the both side walls 25 and 26, there are formed engagement holes 25*a* and 26*a* which are respectively punched into a rectangular shape.

From that portion of the bottom wall 24 in the vicinity of the front end of the electric contact part 23, the elastic contact piece is formed integrally with the bottom wall 24 and turned up backwards. And a pair of support pieces 30 is formed by bending a part of the bottom wall 24 so as to oppose to the lower face of the elastic contact piece 22.

Figure 6:
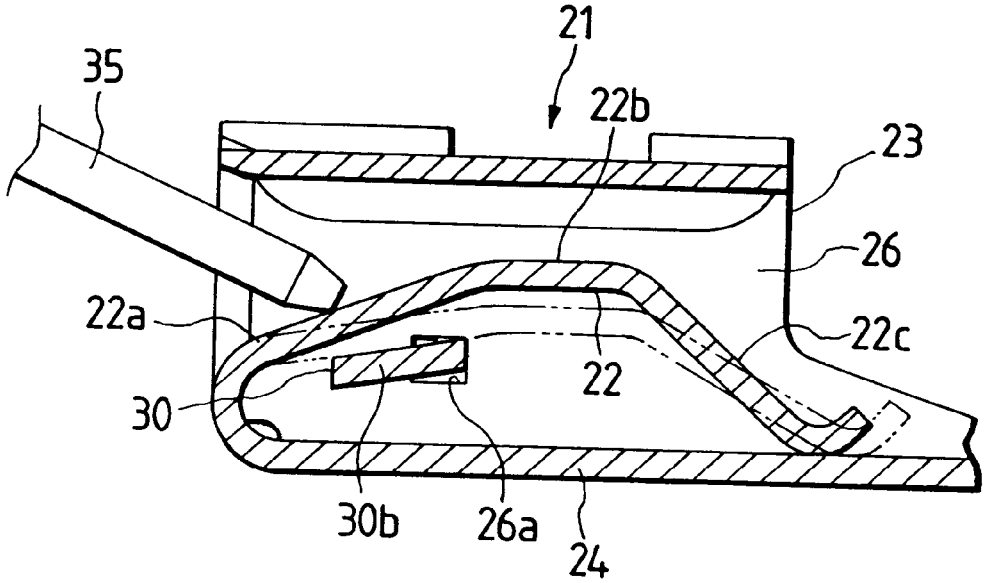
FIG. 6 is a section view taken along the line B—B shown in FIG. 4, explaining a state in which a male terminal is forcibly inserted into the interior portion of the female terminal.
Figure 7:
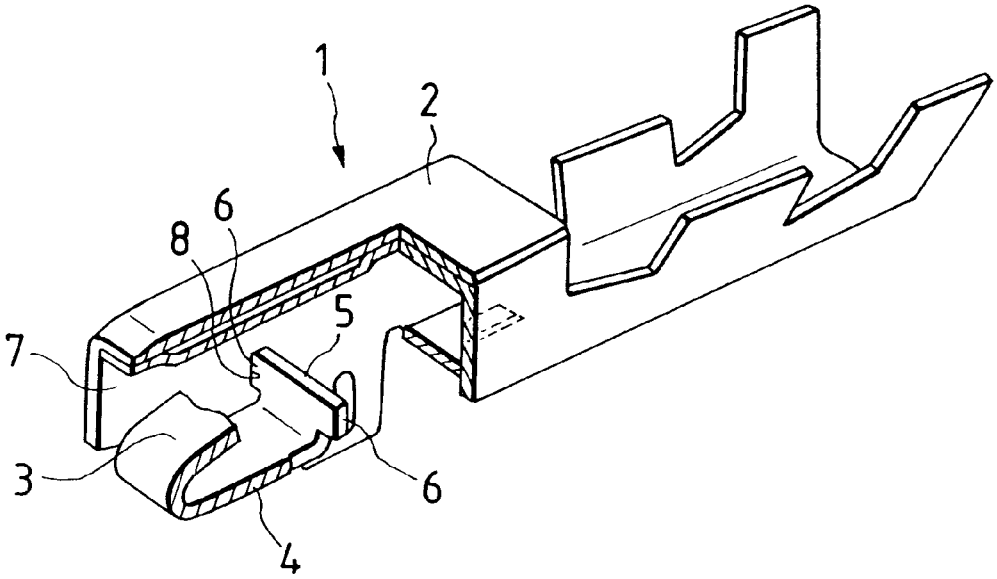
FIG. 7 PRIOR ART
FIG. 7 is a perspective view of a conventional preventive structure for permanent strain of a terminal.
Figure 8:
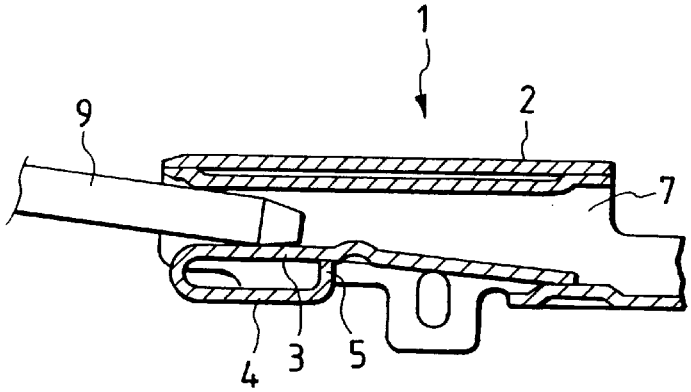
FIG. 8 PRIOR ART
FIG. 8 is a section view of the conventional preventive structure for the permanent strain of the terminal, showing a state in which a male terminal is forcibly inserted into the interior portion of the female terminal shown in FIG. 7.
Figure 9:
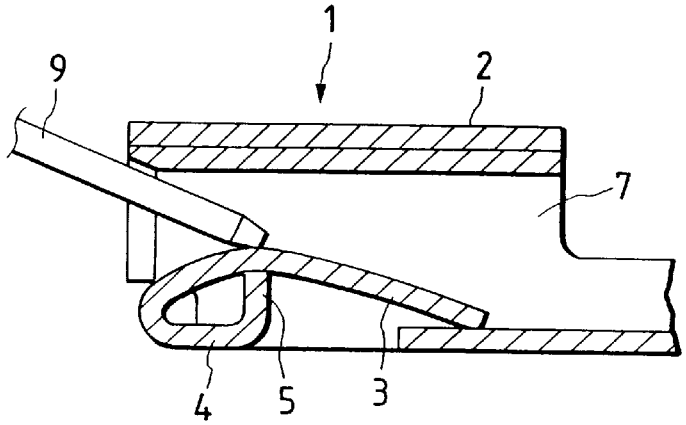
FIG. 9 PRIOR ART
FIG. 9 is a section view of the conventional preventive structure for the permanent strain of the terminal, showing a state in which a male terminal is forcibly inserted into the deep side of the support pieces shown in FIG. 7; and, FIG. 10 is a section view of the conventional preventive structure for the permanent strain of the terminal, showing a state in which a male terminal is forcibly inserted into the front side of the support pieces shown in FIG. 7.
Figure 10:
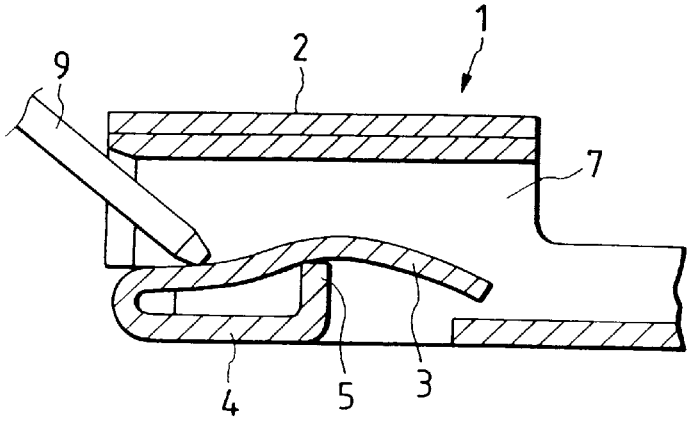
FIG. 10 PRIOR ART

The elastic contact piece 22 includes a front inclined portion 22*a* turned up from the bottom wall 24, an intermediate flat portion 22*b*, and a rear inclined portion 22*c* so formed as to continue with the flat portion 22*b* (see FIG. 6).

The support pieces 30 respectively include base portions 30*a*, which are respectively so bent as to open toward the side walls 25 and 26 from the bottom wall 24 and are raised up at right angles toward the elastic contact piece 22, and leading end portions 30*b* which are respectively formed by bending the present base portions 30*a* so as to be perpendicular to the side walls 25 and 26.

In order to be able to correspond to the flexure of the elastic contact piece 22, the leading end portions 30*b* are respectively inclined in the same direction as the inclination direction of the elastic contact piece 22; and, the leading end portions 30*b* are disposed substantially opposed to the front inclined portion 22*a* of the elastic contact piece 22 with a clearance between them. Also, on the respective edge portions of the leading end portions 30*b*, there are formed securing projections 30*c* which respectively correspond to the engagement holes 25*a* and 26*a* of the two side walls 25 and 26.

Now, as shown in FIGS. 3 and 4, on the inner face of the ceiling wall 27 of the electric contact part 23, there are provided two contact projecting strips 31 in such a manner that they are respectively disposed opposed to the elastic contact piece 22 and extend in the longitudinal direction of the electric contact part 23. In the present embodiment, the support pieces 30 are formed outwardly of the contact projecting strips 31, that is, on the side walls 25 and 26 side. Also, since the support pieces 30 are formed by bending a part of the bottom wall 24, a rectangular opening 32 is formed such that it opens widely.

Figure 5:
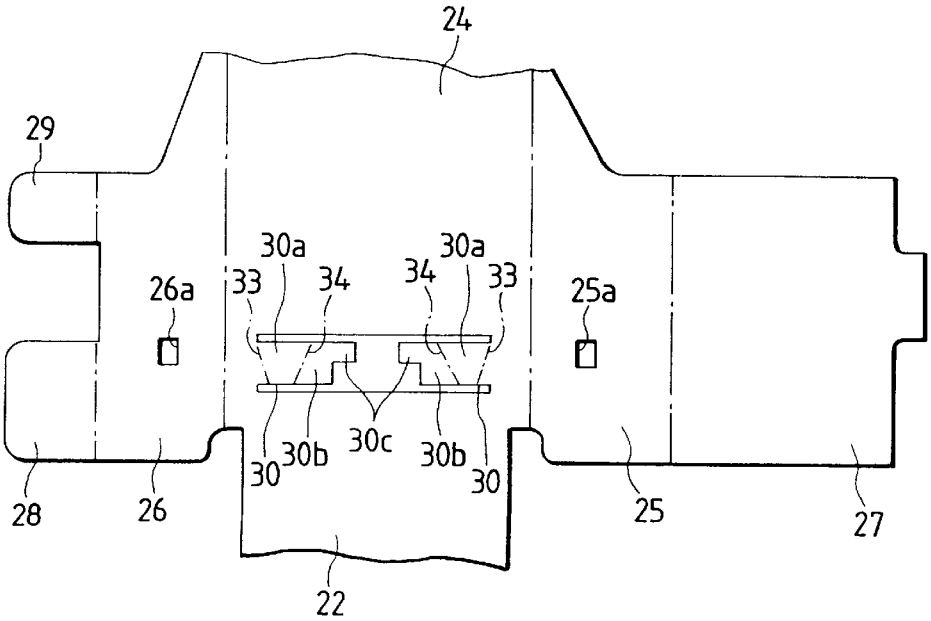
FIG. 5 is a developed view of the electric contact part shown in FIG. 1.

Now, FIG. 5 is a developed view of the present female terminal 21, in which the support pieces 30 are punched and formed in the directions perpendicular to the longitudinal direction of the terminal, which directions provide the both side walls 25 and 26 sides with respect to the bottom wall 24. Also, in the both side walls 25 and 26, there are similarly punched and formed the engagement holes 25*a* and 26*a*. The engagement holes 25*a* and 26*a* are formed such that they are opened slightly greater than the thickness of the securing projections 30*c*, so that, even if a large pushing force is applied thereto, the securing projections 30*c* can be surely engaged with the engagement holes 25*a* and 26*a*.

One side wall 25 is formed such that the ceiling wall 27 continues with one side wall 25, whereas, in the other side wall 26, there are formed the staking pieces 28 and 29. In the front portion of the bottom wall 24 that continues with the support pieces 30, there is provided the elastic contact piece 22.

The bent portions 33 of the base portions 30*a* of the support pieces 30 are respectively arranged inside the width of the elastic contact piece 22 and are inwardly bent with the axis of the terminal between them. Also, the bent portions 34 of the leading end portions 30*b* of the support pieces 30 are respectively bent outwardly with the axis of the terminal between them.

Here, the bottom wall 24, two side walls 25 and 26, ceiling wall 27, and elastic contact piece 22 cooperate together in forming the electric contact part 23. In the rear of the bottom wall 24, there is followed an electric wire pressure mounting part (not shown). The structure shown in FIG. 5 is effective also when it is used as a method for manufacturing a female terminal.

Now, FIG. 6 shows a state in which a male terminal 35 or the like is forcibly inserted into the interior portion of the above structured female terminal 21.

As shown in FIG. 6, even if the male terminal 35 is forcibly inserted into the front inclined portion 22*a* of the elastic contact piece 22 to thereby flex the elastic contact piece 22 toward the bottom wall 24 side, the elastic contact piece 22 is brought into face contact with the inclined leading end portions 30*b* of the support pieces 30 in a wide area and is thereby prevented against excessive flexure, so that the permanent strain of the elastic contact piece 22 can be surely prevented. Also, as shown in FIG. 1, since the securing projections 30*c* of the leading end portions 30*b* of the support pieces 30 are respectively in engagement with the engagement holes 25*a* and 26*a* of the two side walls 25 and 26 of the electric contact part 23, the securing force of the support pieces 30 can be increased and thus, even if a large pushing force is applied to the elastic contact piece 22, the support pieces 30 are surely prevented from falling down or being deformed.

By the way, in the above-mentioned embodiment, the pair of support pieces 30 are used. However, this is not limitative but it is also possible that the base portion 30*a* is punched long from the bottom wall 24 to thereby provide a single support piece. Also, the leading end portions 30*b* may not be turned in the side walls 25 and 26 directions but may be turned inwardly.

As has been described heretofore, according to the invention, since each of the support pieces is composed of a base portion bent from the bottom wall toward the elastic contact member and a leading end portion bent from the base portion toward the side wall of the electric contact part, and the leading end portion is so inclined as to correspond to the flexure of the elastic contact member, when the elastic contact member is flexed, the elastic contact member can be supported in a wide area and in a face contact manner by the leading end portions of the support pieces, which makes it possible to surely prevent the permanent strain of the elastic contact member due to the excessive flexure thereof.

Also, according to the invention, since the engagement hole formed in the side wall is slight larger than the thickness of the securing projections formed on the leading end portion of the support piece engaging with the engagement hole, the securing projection is surely engaged with the engagement hole even though a large pushing force is applied thereto.

Further, according to the invention, since each of the pair of support pieces is so formed as to support both side ends of the elastic contact member respectively, the elastic contact member can always be supported in a stable manner.

It is contemplated that numerous and formal modifications may be made to the structure of the present invention without departing from the spirit and scope of the invention as defined in the following claims.

What is claimed is:

1. A female terminal for electrically contacting with a male terminal, the female terminal comprising:

a first side wall;

an elastic contact member formed on an inner face of the first side wall and extending in a longitudinal direction of the female terminal, the elastic contact member having a flexibility to receive the male terminal; and a support member including a support base member formed on the inner face of the first side wall and a support face member supported by the support base member, on which the elastic contact member flexed by the male terminal is brought into a face-to-face contact.

2. The female terminal as set forth in claim 1 further comprising:

a second side wall perpendicular to the first side wall;

an engagement hole formed in the second side wall; and a securing projection formed on the support face member to engage with the engagement hole.

3. The female terminal as set forth in claim 2, wherein the engagement hole is so formed as to be slightly larger than the size of the securing projection.

4. The female terminal as set forth in claim 1, wherein the support base member is integrally formed with the first side wall.

5. The female terminal as set forth in claim 1, wherein the support member includes a pair of support face members for respectively supporting both side end portions of the elastic contact member, each of the support face members has a securing projection.

6. The female terminal as set forth in claim 1, wherein a contact face defined by the support face member is substantially parallel to the elastic contact member.

* * * * *